US006052339A

United States Patent [19]

Frenkel et al.

[11] Patent Number: 6,052,339

[45] Date of Patent: Apr. 18, 2000

[54] WATCH WITH TOUCH READING AND SETTING OF TIME FUNCTIONS

[75] Inventors: Erik Jan Frenkel, Neuchâtel; Pascal Derivaz, Lommiswil, both of Switzerland

[73] Assignee: Asulab S.A., Bienne, Switzerland

[21] Appl. No.: 09/087,987

[22] Filed: Jun. 1, 1998

[30] Foreign Application Priority Data

Jun. 11, 1997 [CH] Switzerland ..... 1417/97

[51] Int. Cl.[7] ..... G04B 19/06

[52] U.S. Cl. ..... 368/230; 368/281

[58] Field of Search ..... 368/230, 276, 368/281, 282

[56] References Cited

U.S. PATENT DOCUMENTS

| | | | |
|---|---|---|---|
| 4,257,115 | 3/1981 | Hatuse et al. | 368/69 |
| 5,319,616 | 6/1994 | Jolidon | 368/282 |
| 5,365,497 | 11/1994 | Born | 368/230 |
| 5,559,761 | 9/1996 | Frenkel et al. | 368/69 |

FOREIGN PATENT DOCUMENTS

| | | |
|---|---|---|
| 0 715 233 A1 | 6/1996 | European Pat. Off. . |
| 1 422 474 | 1/1976 | United Kingdom . |
| WO 93/03468 | 2/1993 | WIPO . |

OTHER PUBLICATIONS

Patent Abstracts of Japan, vol. 006, No. 038 (P–105), Mar. 9, 1982 & JP 56 155882 A (Seiko Instr. & Electronics Ltd., Dec. 2, 1981, Abstract.

*Primary Examiner*—Bernard Roskoski
*Attorney, Agent, or Firm*—Griffin, Butler, Whisenhunt & Szipl, LLP

[57] ABSTRACT

Watch with visual and touch horometric functions, including:

a case (1) sealed by a crystal (4) arranged above an analogue dial (5) surrounded by a fixed bezel (8)

a time-keeping circuit (10), a stepping motor (11);

a non-acoustic vibration generating device (20);

a power source (24) supplying the circuit (10), the motor (11) and the vibration generating device (20);

twelve sensors ($C_1$ to $C_{12}$) facing the twelve time positions and a control element (9);

an electronic coding circuit (25) associated with the circuit (10), the sensors ($C_1$ to $C_{12}$) and the control device (9) to control the vibration generating device (20);

wherein the bezel (8) has twelve projections ($R_1$ to $R_{12}$) being arranged between the twelve sensors ($C_1$ to $C_{12}$) which extend radially beyond the bezel (8) and the case (1), said projections ($R_1$ to $R_{12}$) to guide a user's finger towards a determined sensor.

8 Claims, 2 Drawing Sheets

WATCH WITH TOUCH READING AND SETTING OF TIME FUNCTIONS

The present invention concerns a watch allowing conventional reading of the time and further including an arrangement intended to facilitate reading and setting of time functions by touch by means of non-acoustic coded vibrations, such a wristwatch being more particularly intended to a visually impaired user, or a sighted user placed in circumstances in which he cannot, or does not wish to consult his watch.

The invention concerns more particularly an analogue display wristwatch whose aesthetic appearance in no way differs from conventional watches and whose technical features, for example as regards water-resistance are superior to those of watches currently used by visually impaired users.

The invention also concerns such a wristwatch whose arrangement as regards the bezel allows a determined touch zone to be more efficiently located, with a reduced number of manipulations for reading and setting a time function, and with simplified acoustic vibration coding.

In U.S. Pat. No. 5,559,761, the Applicant has already disclosed various embodiments of a wristwatch from whose external appearance one cannot tell whether the person wearing it has a visual handicap and which provides time information by means of non-acoustic coded vibrations. For this purpose, it is necessary to perform a number of manipulations of varying complexity on the crown, push-buttons and touch markings, arranged on the surface of the bezel facing sensors incorporated in the bezel or in the crystal. In the various embodiments, the touch markings are formed by recesses or depressions arranged in the bezel, or are separated by projections on the latter, and they only correspond to a single function which may be an operating mode or a time indication. Although the aesthetic object is achieved, the wristwatch disclosed in U.S. Pat. No. 5,559,761 still requires not negligible learning on the part of the user, as regards both the correct positioning of a finger on a determined touch marking, and as regards learning how to manipulate the control elements and the code proposed to provide information via non-acoustic vibrations.

An object of the present invention is to made use of a wristwatch of the aforecited type more reliable as regards the information which it provides and easier use, since it is closer to reflexes already acquired with a conventional watch.

The invention therefore concerns a watch allowing the time to be read in both a visual manner and by touch and wherein the setting of all the time functions is performed by touch, with the exception of initialisation which requires intervention by a sighted person. Such a watch according to the invention includes:

- a case sealed by a crystal arranged above an analogue display dial and time display hands, said crystal being surrounded by a fixed bezel;
- a time-keeping circuit and at least one stepping motor driving the hands;
- a non-acoustic vibration generating device;
- at least one power source supplying the time-keeping circuit, the stepping motor and the vibration generating device;
- a set of twelve sensors arranged facing the twelve time positions and at least one external control element;
- an electronic coding circuit associated with the time-keeping circuit, the sensors and the external control device to control the vibration generating device; characterised in that the bezel is provided with twelve projectionss extending radially beyond the bezel and the case, said projections being arranged between the twelve sensors to guide a user's finger towards a determined sensor.

It has been observed that a visually impaired person is more easily able co follow the contour of an object than a surface with his finger. In the case of the watch, following the contour of the case or the middle part offers the further advantage, as a result of the position of the wristlet and the crown which may be the only external control element, of having clearer identification of the 12 o'clock, 6 o'clock, 3 o'clock and 9 o'clock positions which are the favoured positions, as will be explained hereinafter.

The projections arranged on the bezel for example take the form of small bars slightly longer than the width of the bezel. A casual observer might consider that said small bars have only a decorative purpose, so that it is not possible, by simply observing the watch, to tell whether the wearer is poor sighted or not.

According to the preferred embodiment, the sensors used are of the capacitive type and are arranged under the crystal, above each time position, although it is possible to user other types of sensors according to other arrangements, for example piezoelectric sensors arranged on the bezel. It is also possible to allow the user to receive confirmation that his finger is correctly positioned on a sensor by treating a small portion of the external surface of the crystal situated above each time marking to give it a slight roughness which can be perceived by touch, but is not discernible visually. It is for example possible to form small pellets by laser treatment.

In order to avoid any accidental manipulation of the sensors, the first function of the external control device is to allow passage into touch reading mode when brief pressure is applied thereto. The time information is then selected by positioning the finger on the sensor situated at 12 o'clock for the current time, and at 6 o'clock for the alarm time. The second function of the control element is setting of the current time and setting or changing the alarm time when the crown is pulled, an entirely usual manipulation for the majority of watches.

In "reading " mode, the user has simply to pass his finger through the sensors up to the sensor which starts a coded vibration and whose position he can easily identify by guiding his finger between the projections as far as the level of the periphery of the case. In "setting" mode, the user performs the opposite operation to select a determined sensor. The coding which is the same in both modes is also extremely simple, as will be explained hereinafter. The sensors situated at 3 o'clock and 9 o'clock allow initialisation of the watch to be performed, as is explained hereinafter.

As is seen, the sensors situated at 12 o'clock, 6 o'clock, 3 o'clock and 9 o'clock fulfil two functions which can easily be memorised.

Other features and advantages of the present invention will appear upon reading the following description of an embodiment given by way of example, with reference to the annexed drawings in which.

Figures 1, 2:
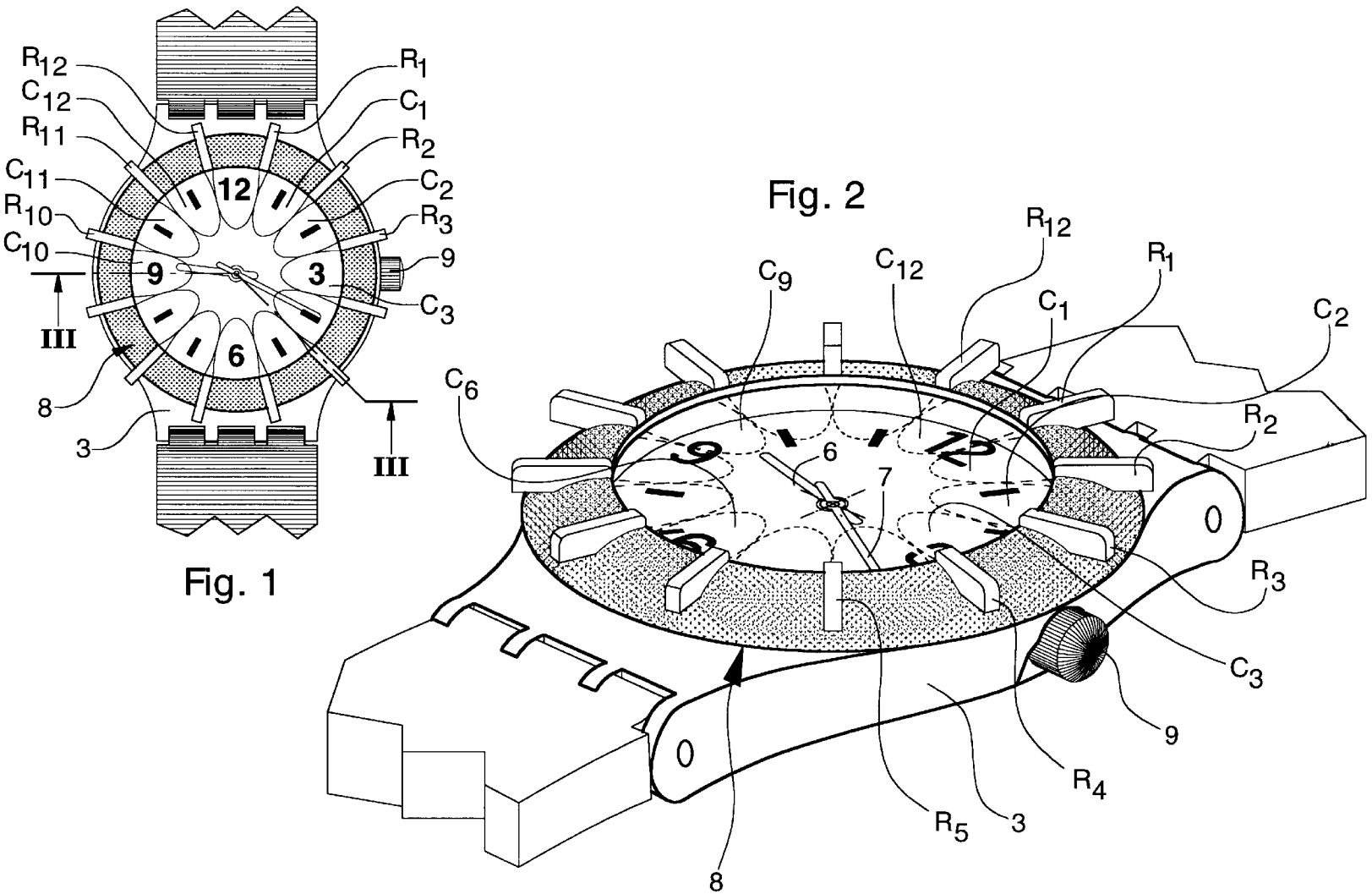
FIG. 1 is a top view of a touch watch according to the invention.
FIG. 2 is a perspective view of the watch shown in FIG. 1.

The watch shown consists of a case 1 formed by a back cover 2 and a middle part 3, and sealed by a crystal 4 arranged above a circular dial 5 and analogue display means comprising hands 6 and 7. Crystal 5 is held in place by a fixed bezel 8 attached to case 1. A push-button 9, which it is possible either to press or pull, is positioned on middle part 3 at 3 o'clock. In the schematic cross-section of FIG. 3, the assembly means are not shown, as they are well known to those skilled in the art. The inner space delimited by dial 5 and back cover 2 is occupied by a clockwork movement, schematically represented by time-keeping circuit 10 and a stepping motor 11, and by a vibratory device 20 supplied by a power source 24 as a function of instructions received from an electronic coding circuit 25 subjected to time-keeping circuit 10.

Figure 3:
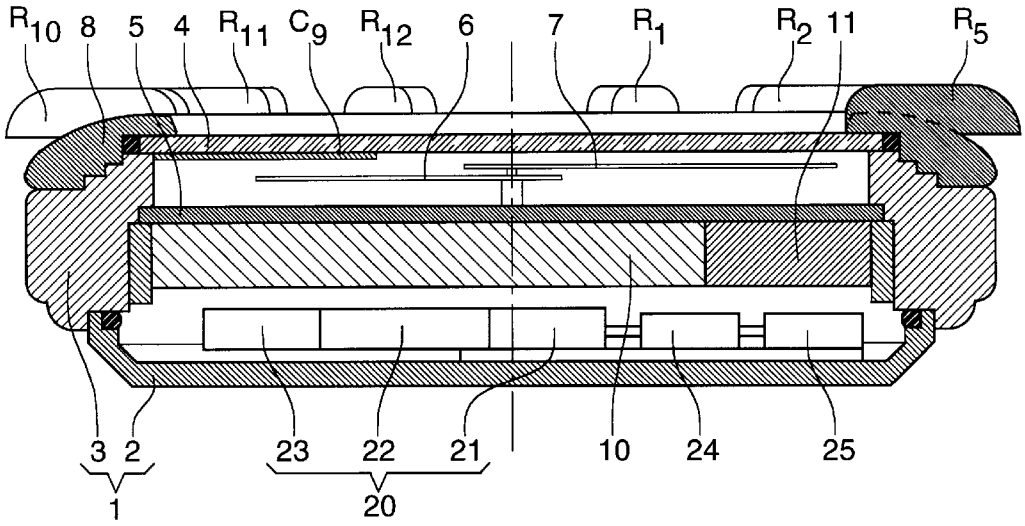
FIG. 3 is a cross-sectional view along the line III—III of FIG. 1.

Vibratory device 20 is for example that disclosed in U.S. Pat. No. 5,365,497. It consists fundamentally of a motor 21 of the electromagnetic type capable of transmitting an oscillatory movement to a weight 23 via a resilient connecting element 22. The vibration, or the train of vibrations, thus generated can be perceived by the user at his wrist, but also at any point of the case. The watch according to the invention allows conventional visual reading of the time by means of hands 6 and 7 and touch reading. This touch reading is performed by means of twelve capacitive sensors $C_1$ to $C_{12}$ arranged under the crystal above each time marking of the dial, the cross-section of FIG. 3 showing sensor $C_9$. The position of each sensor is marked or identify by means of projections or ribs $R_1$ to $R_{12}$ arranged on the bezel between each time marking, and projecting from the periphery of case 1. In the example shown, projections $R_1$ to $R_{12}$ take the form of small bars lightly covering the bezel as appears for projection R5 in FIG. 3. These small bars may be added elements, for example welded or glued to the bezel, or be integral with the bezel.

The structure of the watch which has just been described allows simple touch reading and setting by using a codification of the vibrations which can be easily memorized, as will be understood with reference to the following description of the different time functions.

Reading the current time

The user briefly presses push-button 9 to pass into touch mode, then positions his finger between small bars $R_{12}$ and $R_1$, then slides it for a short instant (less than two seconds) over the crystal above sensor $C_{12}$. It will be observed that by physically separating the marking position on bezel 8 from that of the sensor situated under crystal 5 errors are avoided, which is all the more important for setting operations as will be explained hereinafter. The user then feels a rapid vibration confirming that he is in "time reading" mode. He then moves his finger in proximity to the bezel until he feels a continuous vibration indicating that he is situated above the hour hand. He then identifies this position by sliding his finger over the bezel between two small bars which he can easily identify with respect to the relative position of the wristlet and push-button attachments. In order to know the position of the minute hand he acts in the same way, the vibrations emitted by an active sensor being coded as follows.

Whole multiples of five minutes are coded by a continuous vibration formed of non-enumerated pulses.

The number of minutes past a whole multiple of five minutes is coded by trains formed of one to four non-enumerated pulses.

By way of example, each vibration has a duration of 250 ms, the vibrations forming a train being separated by a silence of 500 ms and each train being separated by a silence of 1,250 ms.

Figure 4:
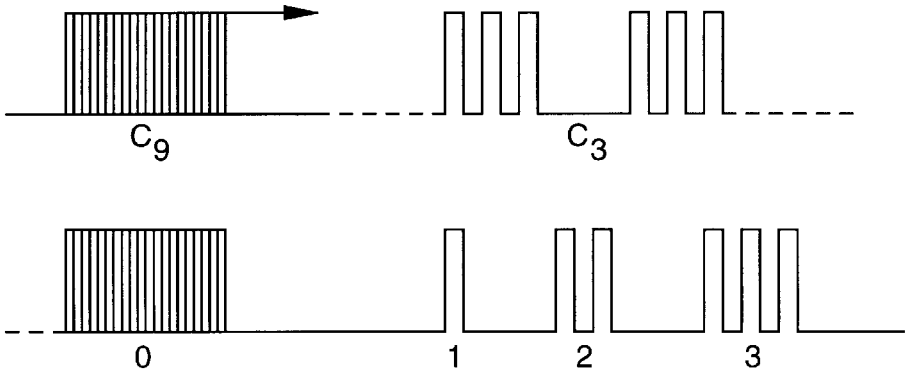
FIG. 4 shows non-acoustic vibration coding examples.

In the example shown in FIGS. 1 and 2, the hands indicate 09.18 hours. The user will first feel a continuous vibration when his finger is positioned on sensor $C_9$, then a train of three vibrations when his finger is positioned on sensor $C_3$. These codifications are schematically shown in FIG. 4. The user will then know the time to a minute, which is sometimes difficult to obtain visually, particularly with watches wherein aesthetic pursuit leads to removal of practically all the time markings.

Reading time and state of alarm

The process is exactly the same as that previously described, but by activating sensor $C_6$ at the beginning instead of sensor $C_{12}$. When the user has his finger on sensor $C_6$, the rapid vibration is coded to indicate the state of the alarm as well.

When the alarm is off (OFF), the train is formed of a rapid vibration.

When the alarm is on (ON), the train is formed of two rapid vibrations.

Change of alarm state

After having briefly pressed crown 9, the user positions his finger as before on sensor $C_6$ but leaving it more than two seconds. The user then feels a train of vibrations formed by the succession of one rapid vibration and two rapid vibrations. In order to set the desired alarm state he removes his finger when he feels, either one vibration (OFF), or two vibrations (ON).

Changing current time or alarm time

After having briefly pressed crown 9 and selected the current time (by positioning his finger on sensor $C_{12}$), or the alarm time (by positioning his finger on sensor $C_6$), the user pulls the crown. The user will then make hour hand 6 and minute hand 7 move successively by acting on sensors $C_1$ to $C_{12}$.

In order to set the hour hand, the user identifies the chosen time position between two small bars $R_1$ to $R_{12}$ and slides his finger onto the corresponding sensor. He then feels a continuous vibration confirming that the hour hand has moved to occupy the position corresponding to the time change that he has selected.

If the user simply wishes to perform a time zone change, or pass from summer time to winter time, he does not perform any other manipulation and the watch will automatically revert to "reading" mode after a certain period of time. If, conversely, he also wishes to set the minute hand he identifies, by means of the small bars, the time position corresponding to the whole multiple of five minutes equal to or immediately lower than the number of minutes selected, then he slides his finger onto the corresponding sensor. The electronic control circuit then emits signals to the vibratory device to generate a train of vibrations coding values 0 to 4, respectively by one continuous vibration, then 1, 2, 3 and 4 unenumerated vibrations separated by silences, this train, shown in FIG. 4 for values 0 to 3, being repeated as long as the user keeps his finger on the sensor. The number of minutes will correspond to the last group of vibrations felt. After the user has removed his finger, minute hand 7 will take up the selected position.

Initialisation

In electronic analogue display watches whose hands are driven by independent stepping motors, it is sometimes necessary to correct the zero referential of the hands. In order to do this, the hands are generally brought one after the other into a superposed position at 12 o'clock. In the absence of other devices, monitoring of this superposition is the only operation having to be performed visually.

The user therefore presses for a long time on the crown (more than five seconds) then pulls. He then positions his finger on sensor $C_9$ until he feels a continuous vibration confirming that the hour hand occupies the 12 o'clock position. Likewise, he moves the minute hand by positioning his finger on sensor $C_3$.

Of course, the invention is not limited to the embodiment which has just been described. Without departing from the scope of the invention, those skilled in the art can adapt the sensor identification method to other horological products

What is claimed is:

1. A watch with visual and touch horometric functions, including :

a case sealed by a crystal arranged above an analogue display dial and hand display means, said crystal being surrounded by a fixed bezel a time-keeping circuit and at least one stepping motor for driving the hands;

a non-acoustic vibration generating device;

at least one power source supplying the timekeeping circuit, the stepping motor and the vibration generating device;

a set of twelve sensors arranged facing the twelve time positions and at least one external control element;

an electronic coding circuit associated with the time-keeping circuit, the sensors and the external control device to control the vibration generating device;

wherein the bezel is provided with twelve projections extending radially beyond the bezel and the case, said projections being arranged between the twelve sensors to guide a user's finger towards a determined sensor.

2. A watch according to claim 1, wherein the sensors are of the capacitive type and are situated under the crystal above each time positions.

3. A watch according to claim 2, wherein small external portions of the crystal facing each time position are treated so as to have slight roughness perceptible by touch, but not discernible visually.

4. A watch according to claim 1, wherein the external control element is a push-button arranged for setting the watch in touch reading mode when said pushbutton is pressed briefly.

5. A watch according to claim 1, wherein the sensors are arranged so that the first activation thereof by positioning a finger selects a determined piece of horometric information.

6. A watch according to claim 5, wherein the sensors allow respectively the current time and the alarm time to be selected, for reading and setting, once passage into touch reading mode has been effected.

7. A watch according to claim 6, wherein the pushbutton is arranged so that a pull exerted thereon allows setting of the current time or the alarm time to be effected.

8. A watch according to claim 5, wherein the sensors are arranged so that successively activating them, having previously pressed for a long time and pulled the pushbutton, allows initialisation of the watch, via visual monitoring of the superposition of the hands at 12 o'clock.

* * * * *